US007216641B2

(12) United States Patent
Friesen et al.

(10) Patent No.: US 7,216,641 B2
(45) Date of Patent: May 15, 2007

(54) LOADING SYSTEM FOR PAINTBALL GUNS

(76) Inventors: Brant Friesen, 402-44th Street East, Saskatoon, SK (CA) S7K 0W1; Shawn Curtis, 402-44th Street East, Saskatoon, SK (CA) S7K 0W1

( * ) Notice: Subject to any disclaimer, the term of this patent is extended or adjusted under 35 U.S.C. 154(b) by 72 days.

(21) Appl. No.: 11/043,740

(22) Filed: Jan. 26, 2005

(65) Prior Publication Data

US 2005/0166904 A1 Aug. 4, 2005

(30) Foreign Application Priority Data

Jan. 29, 2004 (CA) ..... 2456454

(51) Int. Cl.
*F41B 11/02* (2006.01)

(52) U.S. Cl. ..... 124/45; 124/49

(58) Field of Classification Search ..... 124/45, 124/49

See application file for complete search history.

(56) References Cited

U.S. PATENT DOCUMENTS 5,257,615 A * 11/1993 Jones ..... 124/56
5,809,983 A * 9/1998 Stoneking ..... 124/50
6,055,975 A * 5/2000 Gallagher et al. ..... 124/50
6,234,157 B1 5/2001 Parks
6,273,079 B1 * 8/2001 Jzn ..... 124/49
6,722,355 B1 * 4/2004 Andrews, Jr. ..... 124/49
7,000,603 B1 * 2/2006 Steenbeke ..... 124/45

* cited by examiner

*Primary Examiner*—John A. Ricci
(74) *Attorney, Agent, or Firm*—Stites & Harbison, PLLC; David W. Nagle, Jr.

(57) ABSTRACT

A loading system for a paintball gun comprises a paintball reservoir having an outlet at a bottom thereof. An inlet opening is defined in the reservoir, and a door covers the opening when in a closed position, and movable to an open position. A paintball canister has an opening, and a lid covers the opening when in a closed position, and is movable to an open position. The system is configured such that the canister can be engaged with the reservoir with the door and lid in respective open positions such that paintballs in the canister can flow into the reservoir, and the canister can be locked to the reservoir. The system can be configured such that the door and lid open automatically during engagement, and such that the canister ejects when empty.

23 Claims, 5 Drawing Sheets

LOADING SYSTEM FOR PAINTBALL GUNS

This invention relates to devices used in the sport of paintball, and in particular loading systems for paintball guns.

BACKGROUND

The sport of paintball has become increasingly popular since its inception in the early 1980's. Adapting paint marker guns previously used for marking trees and livestock, players have developed a series of informal and formal games in which opposing individuals or teams seeks to score points either through hitting a competitor with a "shot" or by hitting targets. Players may also act out military-style fantasy games in a safe manner through the sport of paintball. Because of the fast-paced excitement of the game, the sport of paintball has become popular worldwide, with millions of participants, organized events, and even professional leagues. As with many other sports, with improvements to paintball guns, gun loading systems and protective equipment, advances in technology have enhanced both the enjoyment and safety of the sport of paintball.

For casual and advanced players, the typical set of gear used in a game includes a paintball gun, paintball ammunition, and protective clothing and eyewear. Such paintball guns are described in U.S. Pat. No. 4,819,609 to Tippman and U.S Pat. No. 4,936,282 to Dobbins et al. Typically, paintball guns include a semi-automatic loading system comprising a paintball reservoir on the top of the gun into which paintballs are poured, and which operates as ammunition storage. Individual rounds are fed from the paintball reservoir into the firing chamber of the gun either by gravity feed or by a motorized feeder. Motorized feeders are especially popular with advanced players as the number of rounds that can be fed per minute is greatly increased over gravity-fed loader systems, allowing the player to take more shots in a given period of time. Thus, the ability to load and fire a paintball gun rapidly is a highly desirable feature of equipment for use in the sport.

In preparation for a game, players will fill the paintball reservoir on the gun with paintballs. Advanced players, and especially those in competitions will also carry additional paintballs, typically in portable plastic canisters or tubes, adapted to fit onto a belt worn by the player. Once the player uses up the paintballs in the paintball reservoir, they will add additional paintballs by opening a portable canister and then pouring the contents into the paintball reservoir. This type of reloading system requires time to open a paintball canister and the hopper and then pour the contents into the gun. This process of manual reloading means that during reloading, the process of opening lids and pouring paintballs occupies the player's attention. Therefore, during reloading it is awkward to fire the paintball gun, and the player is especially vulnerable to attack by other players. As the game of paintball frequently involves fast play and intense action, these distractions and down time place a player who is engaged in the process of reloading at a distinct disadvantage relative to their opponents. Further, reloading often must be done at inconvenient times such as when the player is under attack, or in the middle of an offensive tactical maneuver.

Additionally, pouring paintballs from a portable canister into a hopper is not a precise operation, and prone to errors such as the spilling of paintballs on the ground. Spilled paintballs are invariably discarded, as there is not time to retrieve them during the course of play. In addition, spilling paintballs results in a reduction in the number of shots a player has to use in a game. Similarly, once the lid has been opened on a prior art paintball canister, their is risk of spilling the entire contents of the canister, requiring the player to spend more time reloading, and resulting in further waste of ammunition. U.S. Pat. No. 6,234,157 to Parks is directed toward the problem of spilling paintballs. The Parks patent discloses a portable canister with a petal-shaped valve on one end that opens as the canister is inserted into a compatible valve type opening on a paintball reservoir, which also opens as the canister is inserted. When the paintballs from the canister have flowed into the paintball reservoir, the canister is withdrawn and the opening on the paintball reservoir closes.

SUMMARY OF THE INVENTION

It is an object of the present invention is to provide a paintball loading system that overcomes problems in the prior art.

The present invention provides in one embodiment, a loading system for a paintball gun. The system comprises a paintball reservoir having an outlet at a bottom thereof adapted for connection to a paintball gun such that paintballs contained in the reservoir will flow through the outlet from the reservoir into the paintball gun for firing. An inlet opening is defined in an upper portion of the reservoir, and a door is operative to cover the inlet opening when in a closed position, and movable to an open position. A paintball canister has an opening, and a lid operative to cover the opening in the canister when in a closed position, and movable to an open position. The canister and reservoir are configured such that the canister can be engaged with the reservoir with the door and lid in respective open positions such that paintballs in the canister can flow into the reservoir. A releasable lock is operative to maintain the canister in engagement with the reservoir.

In a second embodiment the invention provides a loading system for a paintball gun. The system comprises a paintball reservoir having an outlet at a bottom thereof adapted for connection to a paintball gun such that paintballs contained in the reservoir will flow through the outlet from the reservoir into the paintball gun for firing. An inlet opening is defined in an upper portion of the reservoir, and a door operative to cover the inlet opening when in a closed position, and movable to an open position, and a door bias element exerts a door bias force on the door. A paintball canister has an outlet opening, and a lid operative to cover the outlet opening when in a closed position, and movable to an open position, and a lid bias element exerts a lid bias force on the lid. The canister and reservoir are configured such that the canister can be moved into engagement with the reservoir, and such that engaging the canister with the reservoir moves the door and lid to respective open positions such that paintballs in the canister can flow into the reservoir. A releasable lock is operative to maintain the canister in engagement with the reservoir.

The loading system of the invention provides a portable paintball canister that removably attaches rapidly and easily to a paintball reservoir on a paintball gun, and which is left in place on the paintball reservoir until it is empty. As paintballs are fired, they exit from the bottom of the paintball reservoir and paintballs flow from the canister into the reservoir. When the paintball canister is empty, it can be removed, leaving the reservoir still at least partially filled with paintballs, and the gun therefore still loaded. At that time the paintball canister can be removed, and replaced immediately, or removed and then replaced later, but prior to the reservoir running empty, in a two stage operation. This provides flexibility to the shooter as to when he must reload, and allows him to choose when to do so.

The apparatus is conveniently configured such that inserting portable canister in the opening in the paintball reservoir automatically opens the lid of the canister and the door of the paintball reservoir, allowing paintballs to flow freely into the reservoir, and prevents the waste of paintballs due to spilling. The portable paintball canister is held in place by the attachment mechanism.

Conveniently, the apparatus comprises a sensor that detects when the canister is empty, and then causes the canister to eject. The door on the paintball reservoir will close to prevent spillage of paintballs. Alternatively or in addition the sensor can alert the player when the portable canister is empty, notifying the shooter that he should replace it with a full canister sometime soon. A system of sensors can be provided to detect the level of paintballs in the loader chamber. The sensors can be adapted to provide a visible or audible warning to a player that the paintball reservoir is nearly empty or at a predetermined level.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

FIGS. 1-7 schematically illustrate a loading system 1 for a paintball gun. The system comprises a paintball reservoir 2 having an outlet 4 at a bottom thereof adapted for connection to a paintball gun such that paintballs contained in the reservoir 2 will flow through the outlet 4 from the reservoir 2 into the paintball gun for firing.

Figure 1:
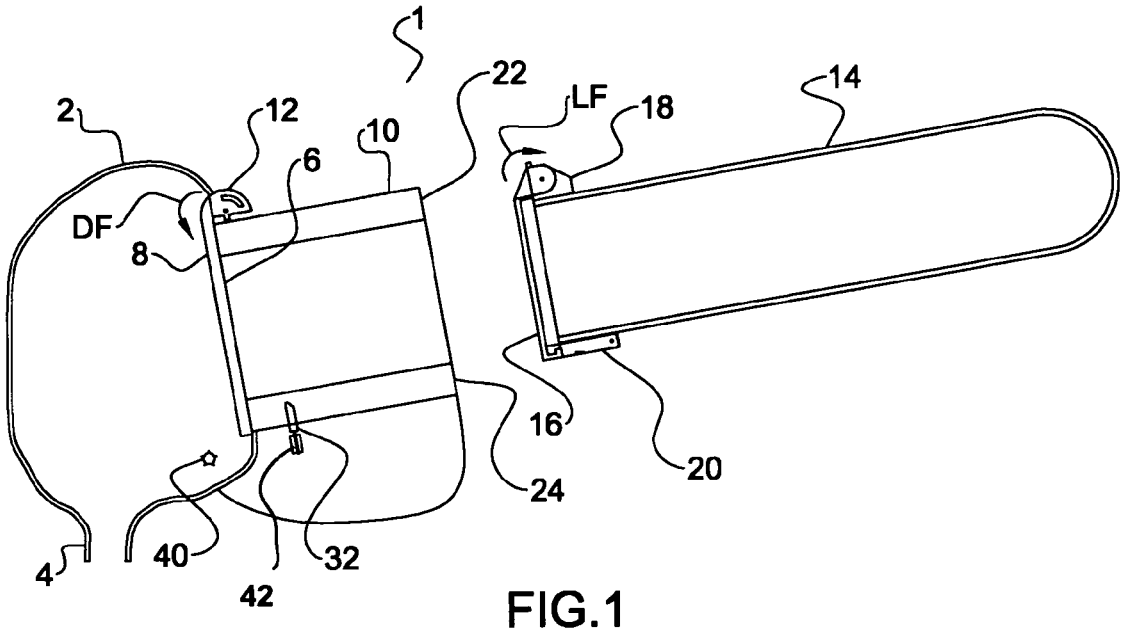
FIG. 1 is a schematic side view of one embodiment of a loading system of the present invention with a hinged lid on the canister and showing the paintball canister adjacent to the reservoir prior to insertion into the sleeve on the reservoir.
Figure 2:
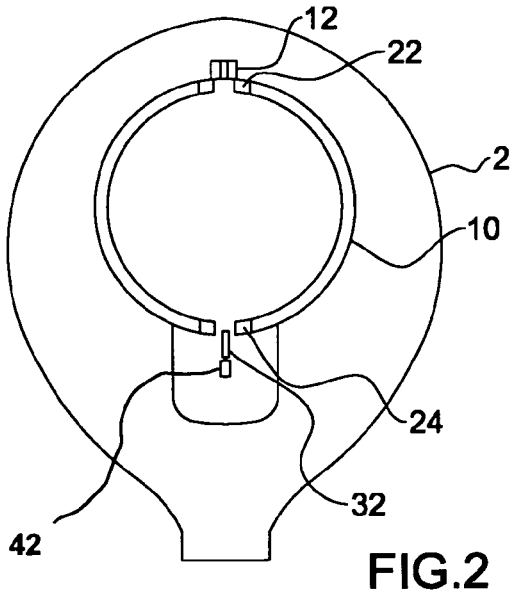
FIG. 2 is a schematic end view of the sleeve on the reservoir in the embodiment of FIG. 1.
Figure 6:
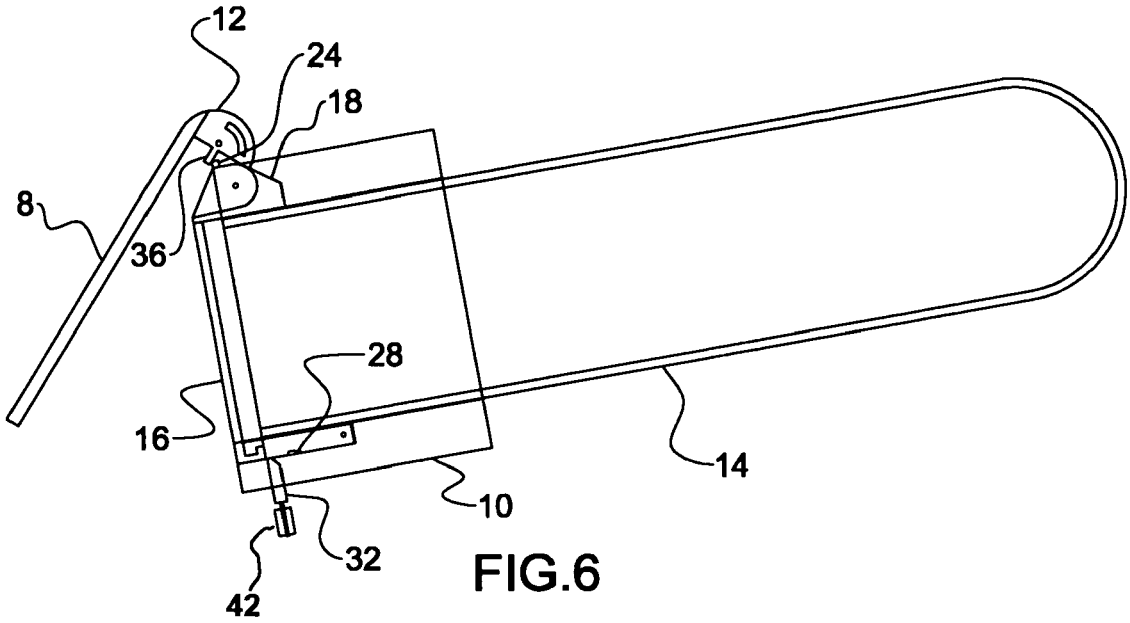
Figure 7:
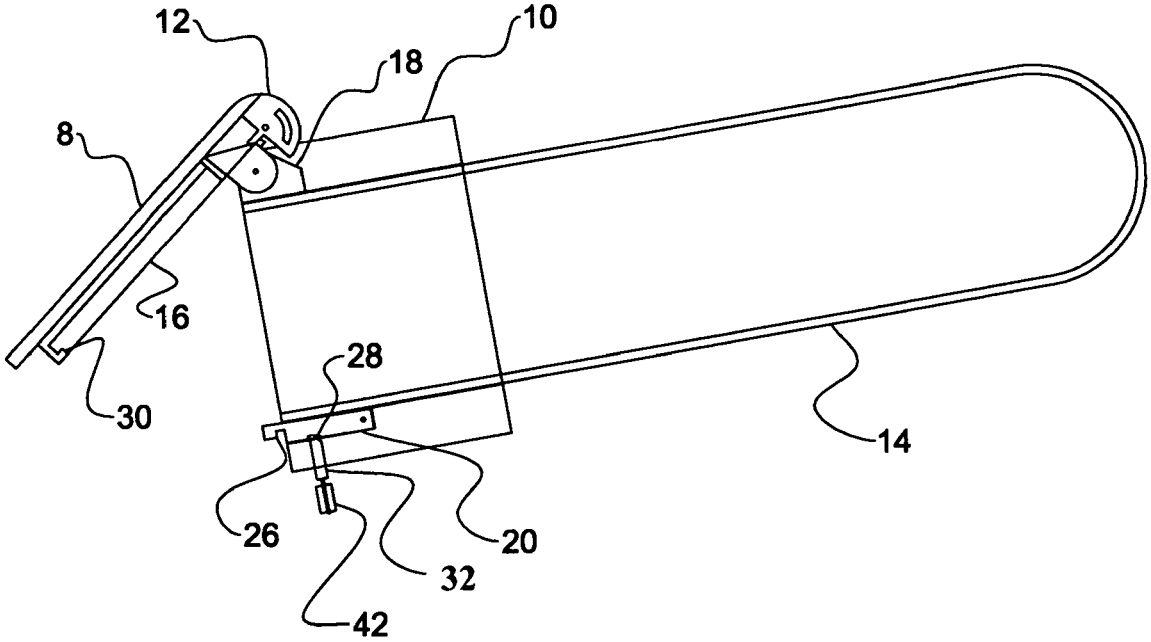
FIG. 7 is a schematic side view of the embodiment of FIG. 1 showing the paintball canister fully engaged in the sleeve.

An inlet opening 6 is defined in an upper portion of the reservoir 2, and a door 8 is operative to cover the inlet opening 6 when in a closed position, as illustrated in FIG. 1, and is movable to an open position, illustrated in FIGS. 6 and 7. In the illustrated embodiment the reservoir 2 comprises a sleeve 10 defining the inlet opening 6 at an inner end thereof, and the door 8 is attached to the reservoir 2 by a door hinge 12 such that when in the closed position the door 8 covers an inner end of the sleeve 10, and when in the open position the door 8 moves into the reservoir 2. A door bias element, conveniently a spring inside the door hinge 12, exerts a door bias force DF on the door 8 toward the closed position.

A paintball canister 14 is open at one end thereof, and a lid 16 is operative to cover the open end of the canister 14 when in a closed position as illustrated in FIG. 1, and the lid 16 is movable to an open position, as illustrated in FIG. 7. In the illustrated embodiment the canister 14 comprises a lid hinge 18 extending laterally from a body of the canister 14, and the lid 16 is attached to the open end of the canister 14 by the lid hinge 18. A lid bias element, conveniently a spring inside the lid hinge 18, exerts a lid bias force LF toward the open position.

A releasable lid latch 20 is operative to maintain the lid 16 in the closed position against the lid bias force LF. As best seen in FIGS. 4-7, the lid latch 20 defines a lip notch 26, and a plunger notch 28, and the lid latch is biased outward from the canister 14. When the lid 16 is moved against the lid bias force LF to the closed position, a lip 30 extending from the lid 16 engages the lip notch 26 and the lid latch maintains the lid 16 in the closed position against the lid bias force LF.

The sleeve 10 comprises a hinge groove 22 therein such that during engagement of the canister 14 with the reservoir 2 the canister 14 is inserted into the sleeve 10 such that the lid hinge 18 moves along the hinge groove 22. A similar latch groove 24 in the sleeve 10 substantially opposite the hinge groove 22 allows the lid latch 20, during insertion, to move along the latch groove 24.

Figure 3:
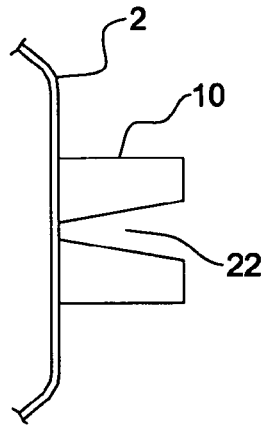
FIG. 3 is a schematic top view of the sleeve on the reservoir in the embodiment of FIG. 1.

As seen in FIG. 3, the hinge groove 22 and latch groove 24 are tapered from a wider portion at outer ends thereof to a narrower portion at inner ends thereof, such that during insertion precise alignment of the lid hinge 18 and lid latch 20 with their respective grooves 22, 24 is not required, and during insertion the canister 14 will rotate in the sleeve 10 to the proper orientation as the lid hinge 18 and lid latch 20 move along the tapered grooves 22, 24.

Figure 4:
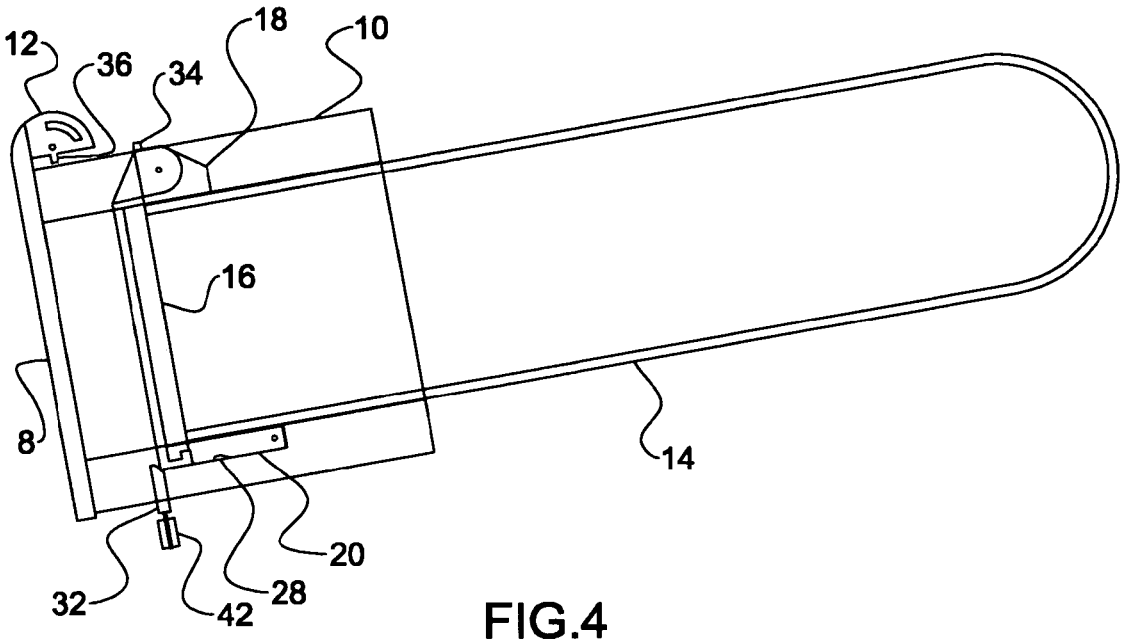
FIGS. 4-6 are schematic side views of the embodiment of FIG. 1 showing the paintball canister moving progressively further into the sleeve.

FIGS. 4-7 show the canister 14 being inserted progressively further into the sleeve 10. In FIG. 4 the lid has just contacted a plunger 32 mounted on the reservoir. The plunger 32 is biased toward the center of the sleeve 10, and as the canister 14 is inserted further, the lid 16 bears against the sloped surface of the plunger 32 and pushes it inward.

Figure 5:
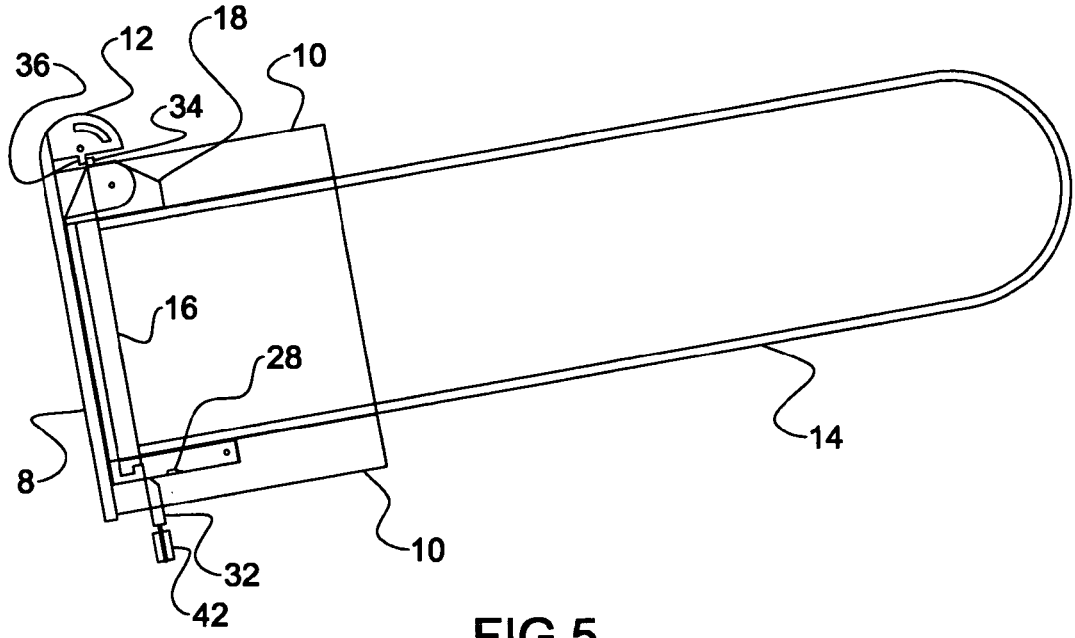

In FIG. 5 the plunger is still bearing against the lid 16 and lug 34 on the lid hinge 18 has just contacted lug 36 on the door hinge 12. In FIG. 6 the lug 34 bears against the lug 36 and pushes the door 8 toward the open position, and the plunger 32 has just passed the edge of the lid 16 and so bears against the lid latch 20. Thus movement of the canister 14 further into the sleeve 10 pushes the lid latch 20 against the plunger 32. The inward bias force on the plunger 32 is greater than the outward bias force on the latch 20, and so the plunger 32 pushes the lid latch 2*o* inward and the lip 30 is released from the lip notch 26, and moves to the open position as illustrated in FIG. 7 in response the lid bias force LF. Engaging the canister 14 with the sleeve in the reservoir 2 thus automatically moves the door 8 and the lid 16 to their open positions so that paintballs can flow from the canister 14 into the reservoir 2.

In an alternate embodiment, the lid bias force LF could be substantially greater than the door bias force, such that when the lid latch 20 was released, the lid bias force was great enough to move the lid 16 into contact with the door 8 and move the door 8 and lid 16 to the open position. In such case the lugs 34, 36 on the door hinge 12 and lid hinge 18 would not be required.

In the position illustrated in FIG. 7, the plunger 32 engages the plunger notch 28 and prevents the canister 14 from moving out of the sleeve 10, thereby providing a lock operative to maintain the canister 14 in engagement with the sleeve 10 on the reservoir 2.

The player operating the paintball gun can then fire paintballs, drawing paintballs out the outlet 4 at the bottom of the reservoir 2, and thus allowing paintballs from the canister 14 to flow through the cooperating openings from the canister 14 into the reservoir 2 until all the paintballs in the canister 14 have flowed into the reservoir 2. At that time the player can remove the empty canister 14, and replace it with a full canister, all the while maintaining his ability to fire the paintball gun because ammunition is still present in the reservoir 2.

The plunger 32 is movable such that the canister 14 can be released from engagement by moving the plunger 32 out of the plunger notch 28. A lever that is manually operated could readily be provided, to move the plunger 32 and allow the player to manually remove the canister 14, however in the illustrated embodiment of FIG. 1, the system is configured to automatically eject the canister 14 when it is empty.

A sensor 40 is provided that is operative to send a sensor signal when the level of paintballs in the reservoir 2 has dropped below a desired level. The sensor 40 can be an LED photoreceptor, electromechanical switch, or like sensor such as are well known in the art. The sensor 40 is connected through a circuit board or the like to a solenoid 42 operative to receive the sensor signal and operative to move the plunger 32 out of the plunger notch 28 in response to the sensor signal. An ejection bias force is exerted against the canister 14 when the canister 14 is engaged with the reservoir 2. This ejection bias force is at least partially provided by the door bias force DF which is urging the canister 14 out of the sleeve 10, and further ejection bias elements can be provided if required, as discussed below. Thus when the level of paintballs in the reservoir 2 falls below the desired level, the sensor 40 triggers the solenoid 42 which draws the plunger 32 out of the plunger notch 28 and the canister 14 is ejected. The door 8 moves to the closed position in response to the door bias force DF so that paintballs don't spill out the inlet opening 6.

Ejecting the empty canister 14 automatically advises the player that it is time to insert a full canister 14, and also saves time in that it is not necessary to remove the empty canister prior to replacing it with a full one. Instead of automatically ejecting the canister 14 when empty, the sensor can instead, or in addition, provide a visible or audible alarm. Further sensors 40 can be provided and configured to warn a player that his ammunition is at any one of a given number of different levels.

Figure 8:
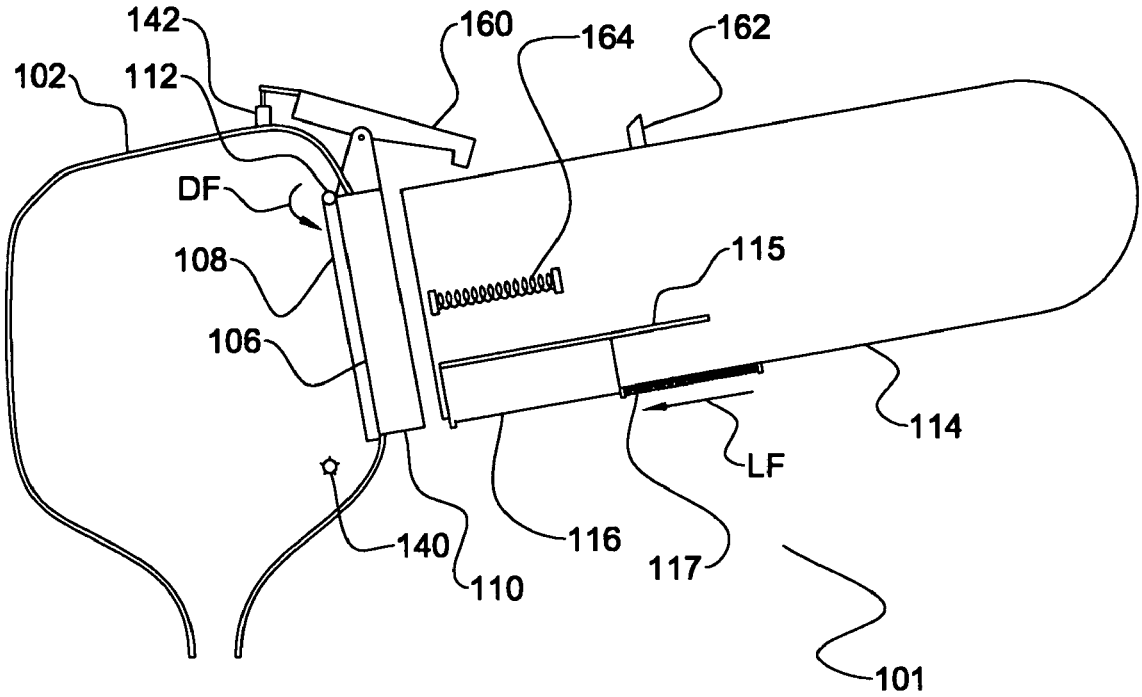
FIG. 8 is a schematic side view of an alternate embodiment of a loading system of the present invention with a sliding lid on the canister and showing the paintball canister adjacent to the reservoir prior to insertion into the reservoir.
Figure 9:
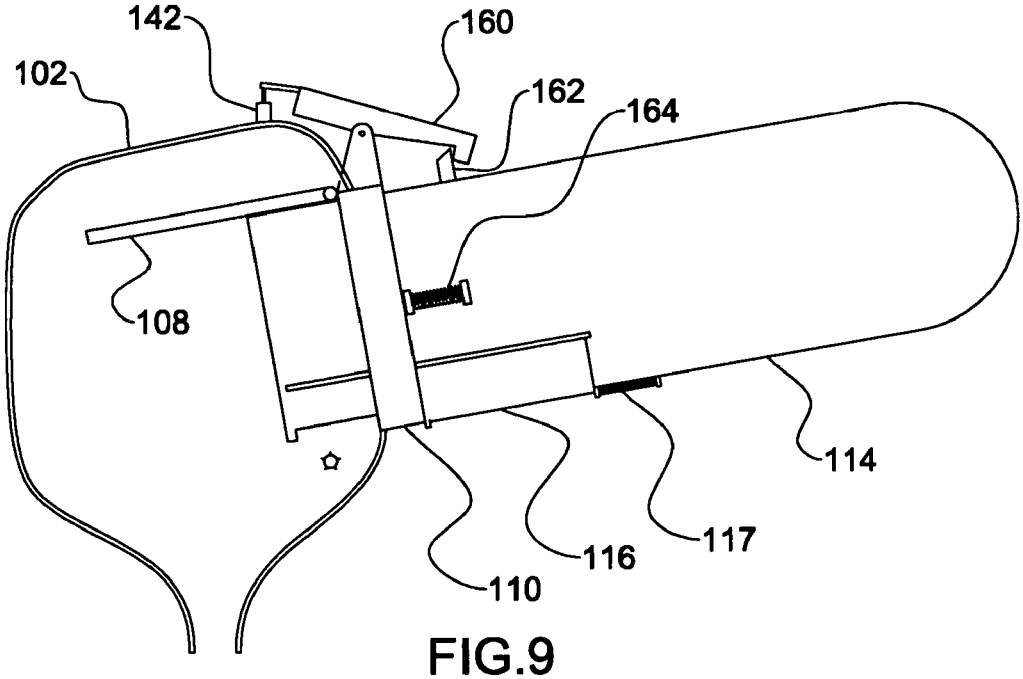
FIG. 9 is a schematic side view of the embodiment of FIG. 8 showing the paintball canister fully engaged in the sleeve.

FIGS. 8 and 9 illustrate an alternate embodiment 101 of the loading system of the invention where the lid 116 is slidably attached to the canister 114 by flanges 115. The reservoir 102 comprises a short sleeve 110 defining the inlet opening 106 and the door 108 is attached to the reservoir 102 by the door hinge 112 such that when in the closed position the door 108 covers an inner end of the sleeve 110, and when in the open position the door 108 moves into the reservoir 102. The door bias force DF is exerted on the door 108 toward the closed position, and the lid bias force LF in this embodiment is exerted on the lid 116 toward the closed position by a lid bias element 117.

To engage the canister 114 with the reservoir 102, the canister 114 is inserted into the inlet opening 106 of the reservoir 102, and during engagement the lid 116 bears against the reservoir 102 at a bottom edge of the outer end of the sleeve 110 and slides toward the open position illustrated in FIG. 9 as the canister 114 is inserted. Inserting the canister 114 into the sleeve 110 causes the canister 114 to bear against the door 108 and move it to the open position of FIG. 9. When fully engaged, the canister 114 is locked to the reservoir 102 by a pivoting latch member 160 that engages a latch peg 162 extending from the wall of the canister 114. Alternatively the latch member 160 could be oriented to engage a notch in the wall of the canister in order to keep the outer surface of the canister 114 smooth such that same does not catch on clothing etc.

Figure 10:
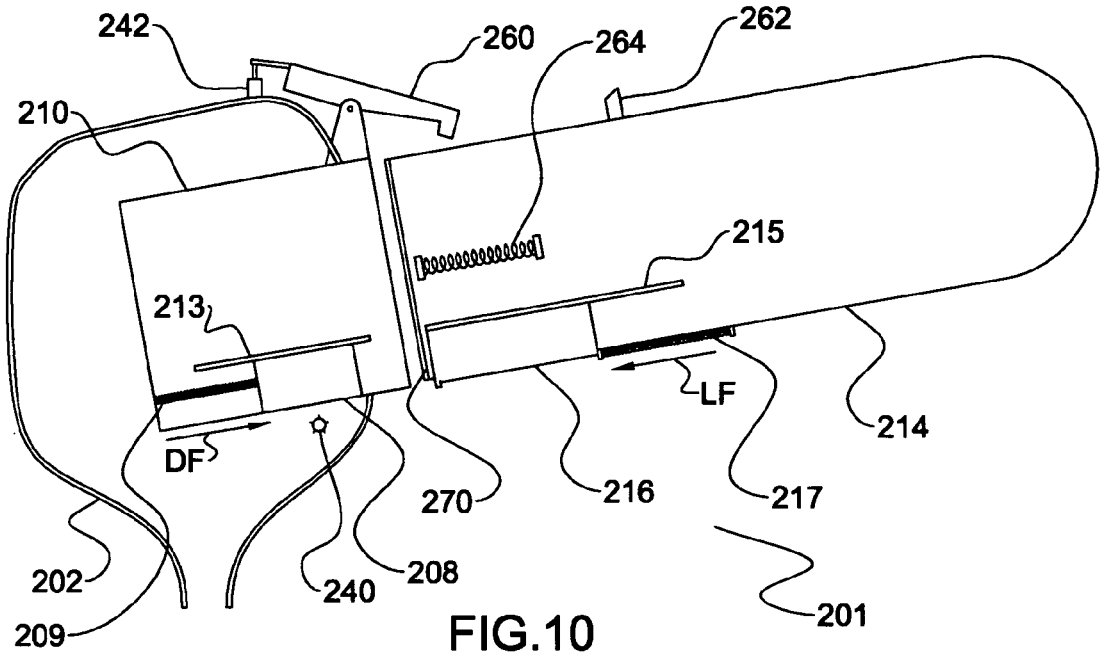
FIG. 10 is a schematic side view of an alternate embodiment of a loading system of the present invention with a sliding lid on the canister and a sliding door on the reservoir, and showing the paintball canister adjacent to the reservoir prior to insertion into the reservoir.
Figure 11:
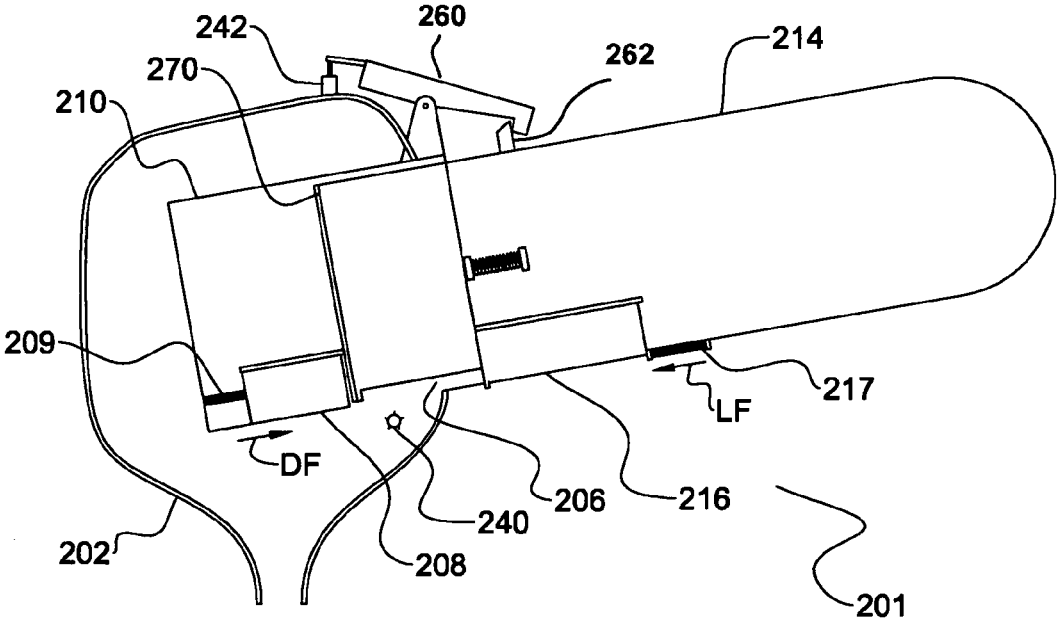
FIG. 11 is a schematic side view of the embodiment of FIG. 9 showing the paintball canister fully engaged in the sleeve.

A sensor 140 is provided that is operative to send a sensor signal when the level of paintballs in the reservoir 102 has dropped below a desired level. The sensor 140 triggers a solenoid 142 operative to move the latch member 160 off the latch peg 162 in response to the sensor signal. An ejection bias force is exerted against the canister 114 when the canister 114 is engaged with the reservoir 102. This ejection bias force is at least partially provided by the door bias force DF which is urging the canister 114 out of the sleeve 110, and in this embodiment also by the lid bias force LF which is also urging the canister 114 out of the sleeve 110. Further ejection bias elements 164 can be provided as required. Thus when the level of paintballs in the reservoir 102 falls below the desired level, the sensor 140 triggers the solenoid 142 and the canister 114 is ejected. The door 108 moves to the closed position in response to the door bias force DF FIGS. 10 and 11 illustrate another alternate embodiment 201 of the loading system of the invention where the lid 216 is slidably attached to the canister 214 by flanges 215. The reservoir 202 comprises a sleeve 210 extending into the interior of the reservoir 202 and defining the inlet opening 206 in a bottom portion thereof. The door 208 is slidably attached to the bottom of the sleeve 210 by flanges 213 such that when in the closed position the door 208 covers the inlet opening 206 in the bottom of the sleeve 210, and when in the open position the door 208 moves toward the inner end of the sleeve 210. The door 208 may be mounted on the inside or the outside of the sleeve 210, and the illustration is schematic only. The door bias force DF is exerted by the door bias element 209 on the door 208 toward the closed position, and the lid bias force LF in this embodiment is exerted on the lid 216 toward the closed position by a lid bias element 217.

To engage the canister 214 with the reservoir 202, the canister 214 is inserted into the inlet opening 206 of the reservoir 202, and during engagement the lid 216 bears against the reservoir 202 at a bottom edge of the outer end of the sleeve 210 and slides toward the open position illustrated in FIG. 9 as the canister 214 is inserted. Inserting the canister 214 into the sleeve 210 causes the canister 214 to bear against the door 208 and move it to the open position of FIG. 10. When fully engaged, the canister 214 is locked to the reservoir 202 by a pivoting latch member 260 that engages a latch peg 262 extending from the wall of the canister 214 or a recess in the wall of the canister 214. The opening in the canister 214 is aligned with the inlet opening 206 of the reservoir, and paint balls can flow into the reservoir 202.

It is generally desirable to fill paintball canisters to full capacity such that the paintballs do not shake and make noise during the game. In the embodiment of FIGS. 10 and 11, filling to full capacity may be difficult through the opening in the canister wall under the lid 216. The canister 214 therefore has an open end and a pop-in top 270 fitted to seal the open end allowing filling through the open end of the canister 214 in a conventional manner.

A sensor 240 is provided that is operative to send a sensor signal when the level of paintballs in the reservoir 202 has dropped below a desired level. The sensor 240 triggers a solenoid 242 operative to move the latch member 260 off the latch peg 262 in response to the sensor signal. An ejection bias force is exerted against the canister 214 when the canister 214 is engaged with the reservoir 202 and is at least partially provided by the door bias force DF which is urging the canister 214 out of the sleeve 210, and in this embodiment also by the lid bias force LF which is also urging the canister 214 out of the sleeve 210. Further ejection bias elements 264 can be provided as required. Thus when the level of paintballs in the reservoir 202 falls below the desired level, the sensor 240 triggers the solenoid 242 and the canister 214 is ejected. The door 208 moves to the closed position in response to the door bias force DF.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

What is claimed is:

1. A loading system for a paintball gun, the system comprising:

a paintball reservoir having an outlet at a bottom thereof adapted for connection to a paintball gun such that paintballs contained in the reservoir will flow through the outlet from the reservoir into the paintball gun for firing;

an inlet opening in an upper portion of the reservoir, and a door operative to cover the inlet opening when in a closed position, and movable to an open position;

a paintball canister having an opening, and a lid operative to cover the opening in the canister when in a closed position, and movable to an open position;

wherein the canister and reservoir are configured such that the canister can be engaged with the reservoir with the door and lid in respective open positions such that paintballs in the canister can flow into the reservoir;

a releasable lock operative to maintain the canister in engagement with the reservoir;

a door bias element exerting a door bias force on the door toward the closed position;

a lid bias element exerting a lid bias force on the lid toward the open position; and a releasable lid latch operative to maintain the lid in the closed position against the lid bias force;

wherein engaging the canister with the reservoir moves the door to the open position, and moves the lid to the open position.

2. The system of claim 1 wherein the door is pivotally attached to the reservoir and the lid is pivotally attached to the canister, and wherein engaging the canister with the reservoir releases the lid latch.

3. The system of claim 2 wherein the reservoir comprises a sleeve defining the inlet opening and wherein the door comprises a door hinge attached to the reservoir such that when in the closed position the door covers an inner end of the sleeve, and when in the open position the door moves into the reservoir.

4. The system of claim 3 wherein the canister comprises a lid binge extending laterally from a body of the canister, and wherein the lid is attached to an open end of the canister by the lid hinge, and wherein the sleeve comprises a hinge groove therein such that during engagement of the canister with the reservoir the canister is inserted into the sleeve such that the lid hinge moves along the hinge groove.

5. The system of claim 4 wherein the sleeve further comprises a latch groove substantially opposite the hinge groove, and wherein during engagement of the canister with the reservoir the canister is inserted into the sleeve such that the lid latch moves along the latch groove into contact with a plunger, and such that moving the canister further into the sleeve pushes the lid latch against the plunger and releases the lid latch.

6. The system of claim 5 wherein the hinge groove and latch groove are tapered from a wider portion at outer ends thereof to a narrower portion at inner ends thereof.

7. The system of claim 6 wherein the lock is provided by the plunger engaging a notch in the lid latch when the canister is engaged with the reservoir and wherein the plunger is movable such that the canister can be released from engagement by moving the plunger out of the notch.

8. The system of claim 7 further comprising:

an ejection bias element operative to exert an ejection bias force against the canister when the canister is engaged with the reservoir;

a paintball sensor operative to send a sensor signal when a level of paintballs in the reservoir falls below a desired level; and a solenoid operative to receive the sensor signal and operative to move the plunger out of the notch in response to the sensor signal;

wherein when the level of paintballs in the reservoir falls below the desired level the canister is ejected.

9. The system of claim 8 wherein the ejection bias element is at least partially provided by the door bias element.

10. The system of claim 5 wherein the lid bias force is greater than the door bias force such that when the lid latch is released the lid moves toward the open position and contacts the door and moves the door toward the open position.

11. The system of claim 4 wherein during engagement of the canister with the reservoir a portion of the canister bears against a portion of the door to move the door toward the open position.

12. A loading system for a paintball gun, the system comprising:

a paintball reservoir having an outlet at a bottom thereof adapted for connection to a paintball gun such that paintballs contained in the reservoir will flow through the outlet from the reservoir into the paintball gun for firing;

an inlet opening in an upper portion of the reservoir, and a door operative to cover the inlet opening when in a closed position, and movable to an open position;

a paintball canister having an opening, and a lid operative to cover the opening in the canister when in a closed position, and movable to an open position;

wherein the canister and reservoir are configured such that the canister can be engaged with the reservoir with the door and lid in respective open positions such that paintballs in the canister can flow into the reservoir;

a releasable lock operative to maintain the canister in engagement with the reservoir;

a door bias element exerting a door bias force on the door toward the closed position; and a lid bias element exerting a lid bias force on the lid toward the closed position;

wherein engaging the canister with the reservoir moves the door to the open position, and moves the lid to the open position;

wherein the lid is slidably attached to the canister, and wherein during engagement of the canister with the reservoir the lid bears against the reservoir and slides toward the open position; and wherein during engagement the canister is inserted into the inlet opening of the reservoir.

13. The system of claim 12 wherein the door is pivotally attached to the reservoir.

14. The system of claim 13 wherein the reservoir comprises a sleeve defining the inlet opening and wherein the door is attached to the reservoir by a door hinge such that when in the closed position the door covers an inner end of the sleeve, and when in the open position the door moves into the reservoir.

15. The system of claim 12 wherein the door is slidably attached to the reservoir.

16. The system of claim 12 wherein the reservoir comprises a sleeve and wherein the inlet opening is located in an inner bottom portion of the sleeve, and wherein when the canister is inserted into the sleeve of the reservoir the canister bears against the door and moves the door toward the open position as it is inserted.

17. A loading system for a paintball gun, the system comprising:

a paintball reservoir having an outlet at a bottom thereof adapted for connection to a paintball gun such that paintballs contained in the reservoir will flow through the outlet from the reservoir into the paintball gun for firing;

a sleeve defining an inlet opening in an upper portion of the reservoir, and a door operative to cover the inlet opening when in a closed position, and movable to an open position;

a paintball canister having an opening, and a lid operative to cover the opening in the canister when in a closed position, and movable to an open position;

wherein the canister and reservoir are configured such that the canister can be engaged with the reservoir with the door and lid in respective open positions such that paintballs in the canister can flow into the reservoir;

a releasable lock operative to maintain the canister in engagement with the reservoir;

a door bias element exerting a door bias force on the door toward the closed position;

a lid bias element exerting a lid bias force on the lid toward the closed position; and wherein engaging the canister with the reservoir moves the door to the open position, and moves the lid to the open position; and wherein the releasable lock engages the sleeve and the canister.

18. The system of claim 17 further comprising:

an ejection bias element operative to exert an ejection bias force against the canister when the canister is engaged with the reservoir;

a paintball sensor operative to send a sensor signal when a level of paintballs in the reservoir falls below a desired level; and a solenoid operative to receive the sensor signal and operative to release the lock in response to the sensor signal;

wherein when the level of paintballs in the reservoir falls below the desired level the canister is ejected.

19. The system of claim 18 wherein the ejection bias element is at least partially provided by the door bias element.

20. The system of claim 18 wherein the ejection bias element is at least partially provided by the lid bias element.

21. A loading system for a paintball gun, the system comprising:

a paintball reservoir having an outlet at a bottom thereof adapted for connection to a paintball gun such that paintballs contained in the reservoir will flow through the outlet from the reservoir into the paintball gun for firing;

an inlet opening in an upper portion of the reservoir, and a door operative to cover the inlet opening when in a closed position, and movable to an open position;

a door bias element exerting a door bias force on the door;

a paintball canister having an outlet opening, and a lid operative to cover the outlet opening when in a closed position, and movable to an open position;

a lid bias element exerting a lid bias force on the lid;

wherein the canister and reservoir are configured such that the canister can be moved into engagement with the reservoir, and such that engaging the canister with the reservoir moves the door and lid to respective open positions such that paintballs in the canister can flow into the reservoir;

a releasable lock operative to maintain the canister in engagement with the reservoir;

an ejection bias element operative to exert an ejection bias force against the canister when the canister is engaged with the reservoir;

a paintball sensor operative to send a sensor signal when a level of paintballs in the reservoir falls below a desired level; and a solenoid operative to receive the sensor signal and operative to release the lock in response to the sensor signal;

wherein when the level of paintballs in the reservoir falls below the desired level the canister is ejected.

22. A loading system for a paintball gun, the system comprising:

a paintball reservoir having an outlet at a bottom thereof adapted for connection to a paintball gun such that paintballs contained in the reservoir will flow through the outlet from the reservoir into the paintball gun for firing;

an inlet opening in an upper portion of the reservoir, and a door operative to cover the inlet opening when in a closed position, and movable to an open position;

a door bias element exerting a door bias force on the door;

a paintball canister having an outlet opening, and a lid operative to cover the outlet opening when in a closed position, and movable to an open position;

a lid bias element exerting a lid bias force on the lid;

wherein the canister and reservoir are configured such that the canister can be moved into engagement with the reservoir, and such that engaging the canister with the reservoir moves the door and lid to respective open positions such that paintballs in the canister can flow into the reservoir;

a releasable lock operative to maintain the canister in engagement with the reservoir;

wherein the outlet opening in the canister comprises a substantially open end on the canister and wherein the lid is pivotally mounted to a lid hinge adjacent to the open end of the canister, and wherein the lid bias force urges the lid toward the open position, and further comprising a releasable lid latch operative to maintain the lid in the closed position against the lid bias force.

23. The system of claim 22 wherein the reservoir comprises a sleeve defining the inlet opening and wherein the door is attached to the reservoir by a door hinge such that when in the closed position the door covers an inner end of the sleeve, and when in the open position the door moves into the reservoir, and wherein during engagement of the canister with the reservoir the canister is inserted into the sleeve and forces the door to the open position.

* * * * *

UNITED STATES PATENT AND TRADEMARK OFFICE

CERTIFICATE OF CORRECTION

PATENT NO. : 7,216,641 B2
APPLICATION NO. : 11/043740
DATED : May 15, 2007
INVENTOR(S) : Friesen et al.

It is certified that error appears in the above-identified patent and that said Letters Patent is hereby corrected as shown below:

IN THE CLAIMS:

Claim 4, col. 8, line 10: Change the word "binge" to --hinge--

Signed and Sealed this

Twenty-fourth Day of July, 2007

JON W. DUDAS
*Director of the United States Patent and Trademark Office*